United States Patent [19]

Kaiser

[11] Patent Number: 4,786,333

[45] Date of Patent: Nov. 22, 1988

[54] BUFFING PAD CLEANING METHOD AND APPARATUS

[76] Inventor: Richard A. Kaiser, 7083 Main St., Merton, Wis. 53056

[21] Appl. No.: 167,737

[22] Filed: Mar. 14, 1988

[51] Int. Cl.[4] ..... A47L 25/00

[52] U.S. Cl. ..... 134/6; 15/1; 15/3; 15/104.92

[58] Field of Search ..... 15/1, 3, 104.92, 142, 15/89; 134/6, 16

[56] References Cited

U.S. PATENT DOCUMENTS 2,877,479 3/1959 Hermance ..... 15/142 X
3,608,120 9/1971 Seiler ..... 15/104.92 X

FOREIGN PATENT DOCUMENTS 771447 11/1967 Canada ..... 15/3

*Primary Examiner*—Edward L. Roberts

*Attorney, Agent, or Firm*—James L. Kirschnik

[57] ABSTRACT

A method and apparatus for cleaning buffing pads while attached to a buffing machine includes a hollow enclosure into which the pad may be inserted and partially enclosed. Rotatable agitating members are provided in combination with the injection of cleaning solutions pumped from a central reservoir onto the pad surface, as the pad is rotated by the buffing machine to which it is normally mounted. Rotation of the pad in contact with the agitating rollers combined with the application of cleaning solution causes the release and washing of particulate matter from the pad. The pad edge is also caused to rotate against stationary protuberances in the enclosure side wall to assist in cleaning the pad as well. A movable cover section is provided for ease of inserting and removing the pad within the enclosure, and the cover includes a central aperture through which the shaft of the buffing machine may be extended.

25 Claims, 2 Drawing Sheets

BUFFING PAD CLEANING METHOD AND APPARATUS

BACKGROUND OF THE INVENTION

1. Field of the Invention

This invention relates to buffing pads which are commonly used with power buffers for buffing and polishing automotive finishes in body shops. Such pads typically are of a disk-like shape and constructed of wool fiber or other soft fibrous materials. During buffing operations, the pads tend to collect particulate matter on the fibers which accumulate and inhibit the buffing action.

2. Description of the Prior Art

In the past, the commonly used methods of cleaning buffing pads have been to rotate the pads in contact with rotatable spurs or remove them and wash them in machines in bulk. Occasionally they were also be hosed off while either removed or in place on the buffing machine. Obvious disadvantages of washing with a hose is the possibility that toxic materials might be washed into the sewer system, and the pad backing may become wet and distorted. Furthermore, removal and cleaning in machines is also expensive and time consuming and may pose problems of storing toxic pads while awaiting cleaning. Additionally washing in machinery tends to deteriorate the pads themselves and shorten their useful life.

SUMMARY OF THE INVENTION

An object of the present invention is to provide an apparatus for cleaning buffing pads which permits the pads to be cleaned by using the buffing machine itself without the necessity of removing the pad from the power buffer.

A further object of the invention is to provide a method and apparatus for cleaning buffing pads which is efficient and confines the debris from cleaning to a container for ease of later disposal.

The subject invention provides for a substantially closed container into which a buffing pad attached to a buffing machine may be inserted. The cleaning container has a series of rotatable agitating wheels which contact the buffing pad during rotation and which serve to agitate the surface of the buffing pad. A pump is provided within a reservoir of cleaning solution and pumps the solution into a manifold which disperses the cleaning solution onto the buffing pad surface while it is being rotated. The cleaning solution is also drained and recirculated back to the reservoir containing the pump.

DESCRIPTION OF A PREFERRED EMBODIMENT

Figure 1:
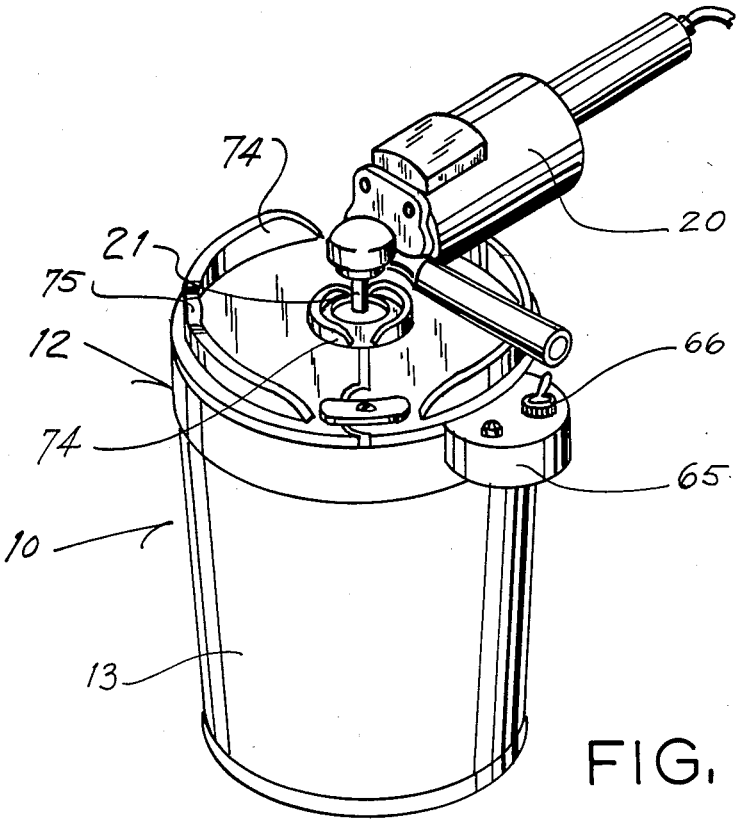
FIG. 1 is a perspective view of a device according to the invention.
Figure 2:
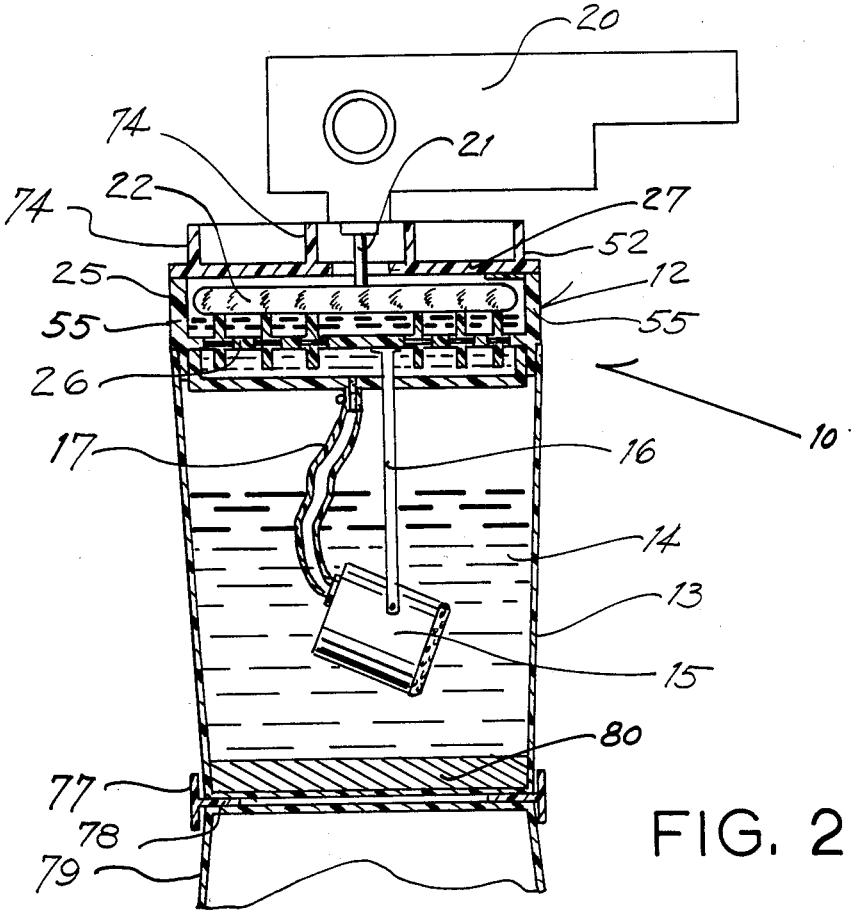
FIG. 2 is a cross sectional side elevation view of a device according to the invention.

As seen in FIGS. 1 and 2, a buffing pad cleaning apparatus 10 includes a pad enclosure 12 affixed to the top of a reservoir 13 containing a cleaning solution 14. A pump 15 is provided which may be supported on suitable brackets 16 attached to the cleaning enclosure 12. The intake of the pump 15 draws fluid from the reservoir 13 and pumps it through a discharge line 17 to a point which will be described hereinafter.

FIGS. 1 and 2 generally show a buffing machine 20. The buffing machine 20 is shown only generally as many different styles and configurations would be usable with the pad cleaning apparatus. Such buffing devices generally include a rotating shaft 21 to which a buffing pad 22 is attached.

Figure 3:
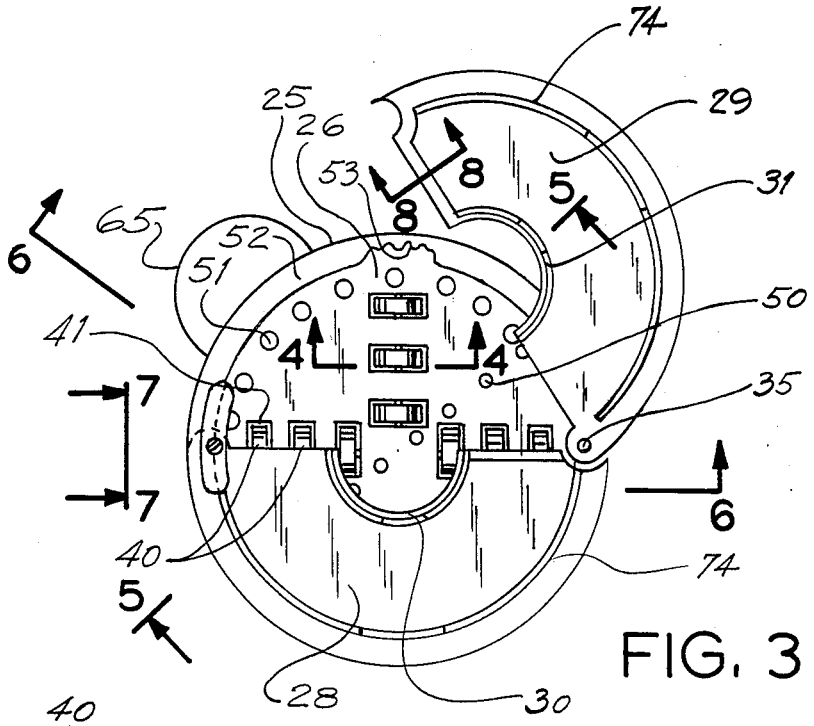
FIG. 3 is a top view of the pad washing apparatus.

With reference to FIGS. 2 and 3, the cleaning enclosure 12 generally includes a cylindrical upstanding side wall 25, having a flat bottom section 26 and cover 27. The cover 27 is divided into two semicircular halves which include a fixed half 28 and a movable access portion 29 best seen in FIG. 3 where the access portion 29 is shown in a partially opened position. A semicircular opening 30 is formed in the fixed cover 28 and a similar semicircular opening 31 formed in the access cover 29. The access cover 29 is pivotably mounted by means of pivot pin 35 and may be pivoted between an open position exposing one half of the interior of the enclosure 12 and a closed position to form a substantially complete cover over the enclosure with the two semicircular openings 30 and 31 aligned to form a central hole through which the buffing machine shaft 21 may extend. Accordingly, pivoting the access cover 29 to an open position allows for the buffing pad to be inserted within the enclosure and the openings 30 and 31 permit the access cover 29 to be closed thereby substantially enclosing the pad 22 within the enclosure while permitting rotation of it while on the buffing machine 20.

Figure 4:
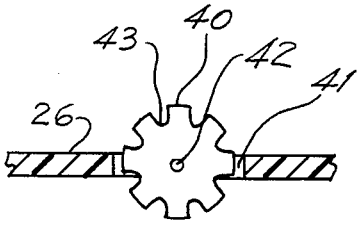
FIG. 4 is a view taken along line 4—4 of FIG. 3.

The bottom 26 of the enclosure 12 has a plurality of vertical upstanding rotatable agitator wheels 40 shown in FIGS. 2, 3 and 4. Each wheel 40 rotates within its own rectangular aperture 41 about a horizontal shaft 42 suitably attached and affixed to the bottom plate 26. Each agitator wheel 40 is generally circular with a plurality of curved indentations 43 spaced along its outer circumference. As seen in FIG. 3, there are two sets of the agitator wheels extending along diameters 90° apart along the bottom 26. The agitator locations are spaced at various distances from the center of the bottom plate 26 so as to engage different radial points of the surface of the pad 22 when it is inserted within the enclosure 12. It will thus be appreciated, that as the pad 22 is rotated with the face of the pad surface touching the agitator wheels 40, the agitator wheels will rotate in response to forces imparted by the rotation of the pad 22, and rotation of the agitator wheels 40 coupled with the arcuate indentations 43 will have a beating like effect on substantially the entire face area of the pad 22.

Figure 5:
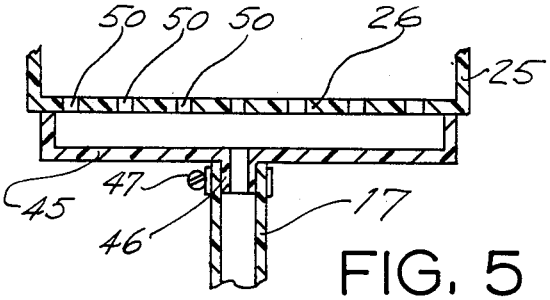
FIG. 5 is a view taken along line 5—5 of FIG. 3.

Referring to FIGS. 2, 3 and 5, an elongated rectangular trough or manifold 45 is affixed to the bottom of the bottom plate 26 and positioned on an angle between the diameter lines of the two sets of agitator wheels 40 to avoid interference with them. Manifold 45 has an inlet extension 46 which is a substantially hollow tube portion extending downwardly within the reservoir 13 onto which the pump outlet line 17 is attached by conventional means such as a clamp 47. The upper edge portion of manifold 45 is sealed to the bottom of plate 26. The interior of manifold 45 communicates with the interior of the enclosure 12 by means of a plurality of cleaning fluid dispersion orifices 50 formed in a line across the bottom plate 26. Thus, activation of the pump 15 will pump fluid through line 17 into the manifold 45 and the fluid will then be discharged upward through orifices 50 and strike the face of the pad 22.

Figure 7:
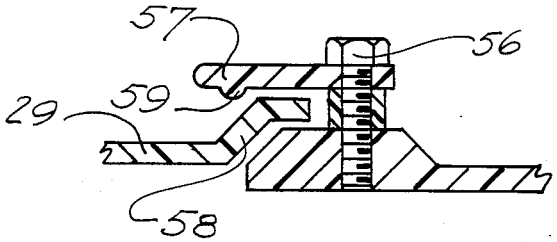
FIG. 7 is a view taken along line 7—7 of FIG. 3.

As seen in FIG. 3, in addition to the agitator slots 41 formed in bottom plate 26, a plurality of drain holes 51 are provided to permit the flow of cleaning solution from the enclosure 12 back into the reservoir 13. Additionally, a semicircular rim 52 extends radially inwardly along the upper edge of the side wall 25 along the portion of the enclosure 12 beneath the access cover 29. This serves as a splash guard and directs splashing fluid within the interior back into the enclosure and prevents it from escaping out the edge between the access cover 29 and side wall 25. Also contained within the enclosure 12 are a plurality of vertically extending nubs 53 spaced around the interior of the side wall 25. The nubs 53 add strength to the container wall and also serve to agitate the outer edge of the pad 22 much like a wash board as it rotates and assist in the removal of particulate matter from the pad 22. A similar function is served by two diametrically opposed upstanding posts 55. The posts are located at the junction line between the fixed cover 28 and the access cover 29 when closed, one serving to secure the pivot pin 35 for the access cover 29 and the second securing a bolt 56 used to attach a cover lock tab 57 as seen in FIG. 7. The lock tab 57 extends toward the free edge of the pivoting cover 29 which has an upstanding portion 58 formed along its outer edge and when closed the upstanding portion 58 is secured by a engaging nub 59 beneath the lock tab 57 as shown in detail in FIG. 7.

Figure 8:
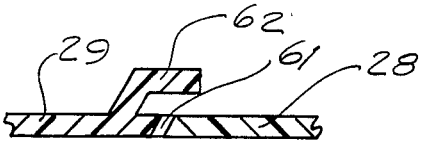
FIG. 8 is a view taken along line 8—8 of FIG. 3.

As shown in FIG. 8, when the access cover 29 is placed in a closed position, its diametrical edge will align with a mating diametrical edge of the fixed cover 28. Because the pads 21 generally consist of elongated fibers, to avoid pinching them between the two cover sections when in a closed position, a small gap 61 is left between the mating diameters. A shield 62 is provided which extends upwardly and outwardly over the gap 61 to prevent splashing and which is further aligned to permit any cleaning solution which spashes up and out of the unit to be drawn back or flow by gravity through the gap 61 when the pad is rotated.

Figure 6:
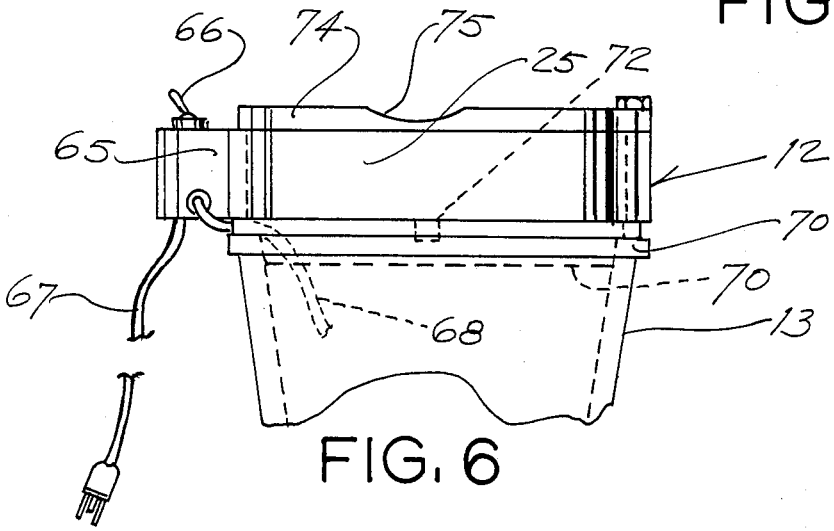
FIG. 6 is a view taken along line 6—6 of FIG. 3.

As seen in FIGS. 1 and 6, a suitable electrical junction box 65 is provided along the outside of side wall 25 to which may be connected a switch 66 and wiring connections between an electrical cord and plug 67 and the connecting cable 68 for providing power to the pump. The electrical connections are not material to the invention and can be performed in any well known manner and are shown generally for the sake of illustration.

FIGS. 2 and 6 also show the method of connecting enclosure 12 to the reservoir 13. A preferred reservoir consists simply of a conventional five gallon plastic pail as commonly used for many bulk fluid materials. An inwardly tapered cylindrical extension 70 is molded within the bottom portion of plate 26 and spaced radially inwardly from the side wall 25 of enclosure 12. The extension 70 is formed and shaped to fit wihtin the opening of the upper edge 71 of the reservoir 13 and further rests on a plurality of spaced lugs 72 which contact the rim of the container.

As seen in FIGS. 1 and 6, the two cover sections 28 and 29 are provided with upstanding spaced semicircular ridges 74. The ridges provide added strength and rigidity to the cover sections 28 and 29, and each ridge is preferably provided with an arcuate depression 75 which may form a cradle for the buffing machine 20. Additionally, as seen in FIG. 2, a circular adaptor ring 77 is provided which consists of a hoop having a radially inwardly projecting rim 78 midway between the top and bottom of said hoop. The ring is sized and adapted to fit beneath the reservoir 13, and may also rest on a cylindrical stand 79 supported on the ground. In practice, a conventional five gallon plastic pail as is commonly used and manufactured for many purposes, has been used as a convenient reservoir. A similar bucket may be inverted and with the adaptor ring, an inexpensive stand is provided to elevate the upper reservoir 13 and more conveniently set the height of the buffing machine 20 for the operator.

Having thus described the construction of the apparatus, the operating characteristics will now be described. In practice, the cleaning fluid 14 may consist of any number of different solvents or cleaning solutions or even water. A preferred and highly satisfactory solution is that of citric turpin which is a very effective and yet biodegradable solution. The reservoir 13 is filled to a sufficient level with the solution 14 and the cleaning enclosure 12 put in place on the top with the pump 15 extending within the fluid. Access cover 29 is opened to permit the insertion of a pad 22 attached to the buffing machine 20 and cover 22 closed and latched as previously described. When the pump is turned on, the cleaning solution 14 will begin to circulate through line 17 to the manifold 45 and fluid will be dispersed upward through orifices 50 onto the face of the pad 22. At the same time, the buffer is turned on and the pad 22 begins to rotate with the cleaning solution continuously sprayed upward onto its face. Rotation of the pad 22 combined with the application of cleaning solution and contact with the agitating rollers 40 help to dislodge particulate matter embedded in the face of pad 22. Additionally, the wick-like action of fluid solution absorbed within the pad is dispersed outwardly by centrifugal force to the periphery of the pad and the impact of the outer edge of pad 22 against both the posts 55 and nubs 53 along the interior surface of side walls 25 have a similar agitating action to clean the pad edges. As the cleaning solution is dispersed within the container 12, gravity will cause it to flow through the drain holes 51 as well as the rectangular slots 40 and return to the reservoir to complete the fluid cycle. The splash rim 52 serves to keep solution from seeping out around the upper edges of the container as well as the fixed cover 28 which is sealed along the edge of side walls 25. Furthermore, any fluid which makes its way up through the central opening formed by the openings 30 and 31 will be drawn back down or flow by gravity through the gap 61 between the mating edges of the two cover sections.

In practice it has been found that pads cleaned in this fashion save time in that they need not be removed from the buffing machine and may be utilized immediately for buffing following the cleaning procedure. Accumulated cleaning solution within the pad 22 may be removed simply by turning off the pump and continuing to rotate the pad 22 within the enclosure 12 and centrifugal force will discharge the solution from the pad 22. Furthermore, the particulate matter will settle and accumulate within the reservoir 13 in the form a sledge or sediment layer 80 as shown in FIG. 2. Thus the sediment is centrally contained and may be easily disposed of properly depending on the nature of the sediment and whether special disposal procedures are necessary. Even new pads may be processed with the invention to remove loose wool and fibers before being used for buffing. It has also been found that dampening the pads either before their first use or after cleaning enhances cutting and polishing.

While a preferred embodiment of the invention has thus been described, those skilled in the art will appreciate that many variations are possible without deviating from the scope or intention of the invention. For example, the preferred materials for constructing the enclosure 12 are injected molded polyvinyl chlorine. Certainly other and more expensive materials could be utilized as well. Plastic type materials are preferred due to their resistance to corrosion and economical manufacture. Because of the abuse to which the agitating rollers 40 are subjected, a stronger material such as acetal type plastic is preferred. Additionally other agitating variations such as larger and fewer rollers or even fixed members are possible. Similarly the metal connections, brackets, bolts, pins and shafts are preferably made of corrosive resistant materials such as stainless steel or other suitable metals. Accordingly, the scope of the invention is to be taken solely from an interpretation of the claims which follow.

I claim:

1. Apparatus for cleaning power driven buffing pads having a buffing face and edge portion while the pads are mounted on a buffing machine adapted to rotate the buffing pads comprising:

A. hollow enclosure means for receiving and containing buffing pad while attached to a buffing machine;

B. rotatable agitator means mounted within said enclosure for contacting the face of said buffing pad whereby rotation of said buffing pad will cause said agitator means to rotate while contacting the pad buffing face;

C. reservoir means for containing a solution of cleaning fluid; and,

D. pump means for pumping cleaning solution from said reservoir means into said hollow enclosure and onto said buffing pad.

2. Apparatus as set forth in claim 1 wherein said enclosure means includes movable cover means for covering said enclosure after said buffing pad is inserted therein, said cover means including a central aperture for permitting said pad to be rotated within said enclosure means while attached to the buffing machine.

3. Apparatus as set forth in claim 2 wherein said cover means comprises a first substantially semicircular section fixedly mounted on said enclosure means a second substantially semicircular pivotable portion which may be pivoted between an open and a closed position.

4. Apparatus as set forth in claim 3 wherein said cover means includes releasable latch means for securing said first and second cover portions in said closed position.

5. Apparatus as set forth in claim 4 including manifold means affixed to the bottom of said enclosure means for directing cleaning solution from said pump means upwardly into contact with said buffing pad.

6. Apparatus as set forth in claim 5 wherein said enclosure means including cylindrical side walls and a bottom, said bottom having one or more drain holes for permitting cleaning fluid to drain from said container.

7. Apparatus as set forth in claim 6 wherein said agitating means comprises a plurality of rotatable agitating wheels mounted on said bottom within individual apertures formed in said bottom for each agitating wheel.

8. Apparatus as set forth in claim 7 wherein said reservoir means comprises a substantially cylindrical container having an open top and said enclosure means is adapted to be supported over said top of said container.

9. Apparatus as set forth in claim 8 wherein said reservoir comprises a conventional five gallon plastic pail.

10. Apparatus as set forth in claim 9 including adaptor ring means for connecting the bottom of said pail to the bottom of an inverted conventional five gallon pail to form a supporting stand.

11. Apparatus as set forth in claim 6 wherein said cylindrical enclosure side walls include a plurality of spaced protuberant portions extending radially inward into contact with the edge portion of said buffing pad when placed said enclosure.

12. Apparatus as set forth in claim 2 including manifold means affixed to the bottom of said enclosure means for directing cleaning solution from said pump means upwardly into contact with said buffing pad.

13. Apparatus as set forth in claim 12 wherein said enclosure means including cylindrical side walls and a bottom, said bottom having one or more drain holes for permitting cleaning fluid to drain from said container.

14. Apparatus as set forth in claim 13 wherein said agitating means comprises a plurality of rotatable agitating wheels mounted on said bottom within individual apertures formed in said bottom for each agitating wheel.

15. Apparatus as set forth in claim 14 wherein said reservoir means comprises a substantially cylindrical container having an open top and said enclosure means is adapted to be supported over said top of said container.

16. Apparatus as set forth in claim 15 wherein said reservoir comprises a conventional five gallon plastic pail.

17. Apparatus as set forth in claim 16 including adaptor ring means for connecting the bottom of said pail to the bottom of an inverted conventional five gallon pail to form a supporting stand.

18. Apparatus as set forth in claim 1 including manifold means affixed to the bottom of said enclosure means for directing cleaning solution from said pump means upwardly into contact with said buffing pad.

19. Apparatus as set forth in claim 1 wherein said enclosure means including cylindrical side walls and a bottom, said bottom having one or more drain holes for permitting cleaning fluid to drain from said enclosure means.

20. Apparatus as set forth in claim 19 wherein said cylindrical enclosure side walls includes a plurality of spaced protuberant portions extending radially inward into contact with the edge portion of said buffing pad when placed in said enclosure.

21. Apparatus as set forth in claim 1 wherein said agitating means comprises a plurality of rotatable agitating wheels mounted on said bottom within individual apertures formed in said bottom for each agitating wheel.

22. Apparatus for cleaning power driven buffing pads having a buffing face and edge portion while the pads are mounted on a buffing machine adapted to rotate the buffing pads comprising:

A. hollow enclosure means for receiving and containing a buffing pad while attached to a buffing machine;

B. agitator means mounted within said enclosure for contacting the face of said buffing pad whereby rotation of said buffing pad will cause said buffing face to intermittently contact said agitator means;

C. pump means for pumping cleaning solution into said hollow enclosure and onto said buffing pad face.

23. Apparatus for cleaning power driven buffing pads having a buffing face and edge portion while the pads are mounted on a buffing machine adapted to rotate the buffing pads comprising:

A. hollow enclosure means for receiving and containing a buffing pad while attached to a buffing machine;

B. rotatable agitator means mounted within said enclosure for contacting the face of said buffing pad whereby rotation of said buffing pad will cause said agitator means to rotate while contacting the pad buffing face;

C. pump means for pumping cleaning solution into said hollow enclosure and onto said buffing pad face.

24. A method of cleaning a buffing pad while mounted to a buffing machine comprises the steps of:

A. inserting a buffing pad mounted to a buffing machine into a hollow enclosure;

B. rotating said buffing pad within said enclosure while in contact with a plurality of rotatable agitating wheels contained within said enclosure in contact with said buffing pad; and, C. spraying a cleaning solution into contact with said buffing pad while it is rotating within said enclosure in contact with said agitating wheels.

25. The method set forth in claim 24 including collecting said cleaning solution from said container and recirculating the same to a reservoir.

* * * * *